US005716295A

United States Patent [19]

Anglea

[11] Patent Number: 5,716,295

[45] Date of Patent: Feb. 10, 1998

[54] DEVICE TO BUILD A PITCHER'S MOUND

[75] Inventor: James H. Anglea, Arlington, Tex.

[73] Assignee: Anglea Turf Concepts, Inc., Arlington, Tex.

[21] Appl. No.: 477,748

[22] Filed: Jun. 7, 1995

[51] Int. Cl.[6] ..... A63C 19/06

[52] U.S. Cl. ..... 473/497

[58] Field of Search ..... 249/3, 8; 273/25; 33/419, 426, 427, 448, 458, 461; 473/497, 499, 500, 501

[56] References Cited

U.S. PATENT DOCUMENTS 925,014 6/1909 Murnane ..... 273/25

3,889,379 6/1975 Cline ..... 273/25

4,510,692 4/1985 Overholdsen ..... 273/25

5,467,977 11/1995 Beck ..... 273/25

*Primary Examiner*—Theatrice Brown

*Attorney, Agent, or Firm*—Harry C. Post, III

[57] ABSTRACT

A device used to assist in constructing and repairing a pitcher's mound on a playing surface in a baseball field. An upper limit to the pitcher's mound is indicated by a beam apparatus. The beam apparatus has a horizontal extension member for indicating a plane above the playing surface that lies substantially parallel to the playing surface. An angled extension member is disposed to angle down a slope from a point where connected to the horizontal extension member. A support device supports the horizontal extension member of the beam at a chosen position above the playing surface.

6 Claims, 2 Drawing Sheets

DEVICE TO BUILD A PITCHER'S MOUND

TECHNICAL FIELD

This invention relates to a device used in building a pitcher's mound and, more especially, a light weight device used to assist in constructing and repairing a pitcher's mound on a playing surface in a baseball field.

BACKGROUND ART

It is well known that a baseball playing field is provided with a pitcher's mound from which the pitcher delivers the ball, such as a baseball or softball, to the batter. The size and location of the pitcher's mound is laid out on the playing field according to the rules governing the play of baseball, which, for purposes of this invention, includes softball. The pitcher's mound is obtained by piling dirt on top of the playing surface of the playing field to the elevation and size allowed by the rules. Since the mound is made of dirt, it is frequently damaged during play. Further, before a baseball field may be used after being idle for a long period of time, such as between the end of a season and the beginning of the next season, it is necessary for it to be inspected and reconditioned. In the past, a large number of highly skilled grounds keepers were required to find the proper location where the mound was to be constructed, and to repair the mound after being damaged. Thus, the construction and repair work was time consuming and expensive.

Accordingly, it is an object of the present invention to provide a device to assist in readily constructing or repairing a pitcher's mound on a playing surface in a baseball field.

Further, it is an object of the present invention to provide a light weight device to assist in readily constructing or repairing a pitcher's mound on a playing surface in a baseball field.

DISCLOSURE OF THE INVENTION

In accordance with the present invention there is provided a device used to assist in constructing a pitcher's mound on a playing surface in a baseball field. An upper limit to the pitcher's mound is indicated by a beam apparatus. The beam apparatus has a horizontal extension member for indicating a plane above the playing surface that lies substantially parallel to the playing surface. An angled extension member is disposed to angle down a slope from a point where connected to the horizontal extension member. A support device supports the horizontal extension member of the beam at a chosen position above the playing surface.

BRIEF DESCRIPTION OF THE DRAWINGS

Other objects and advantages of the invention will become apparent upon reading the following detailed description and upon reference to the drawings, wherein like reference characters are used throughout to designate like parts.

BEST MODE FOR CARRYING OUT THE INVENTION

Figure 1:
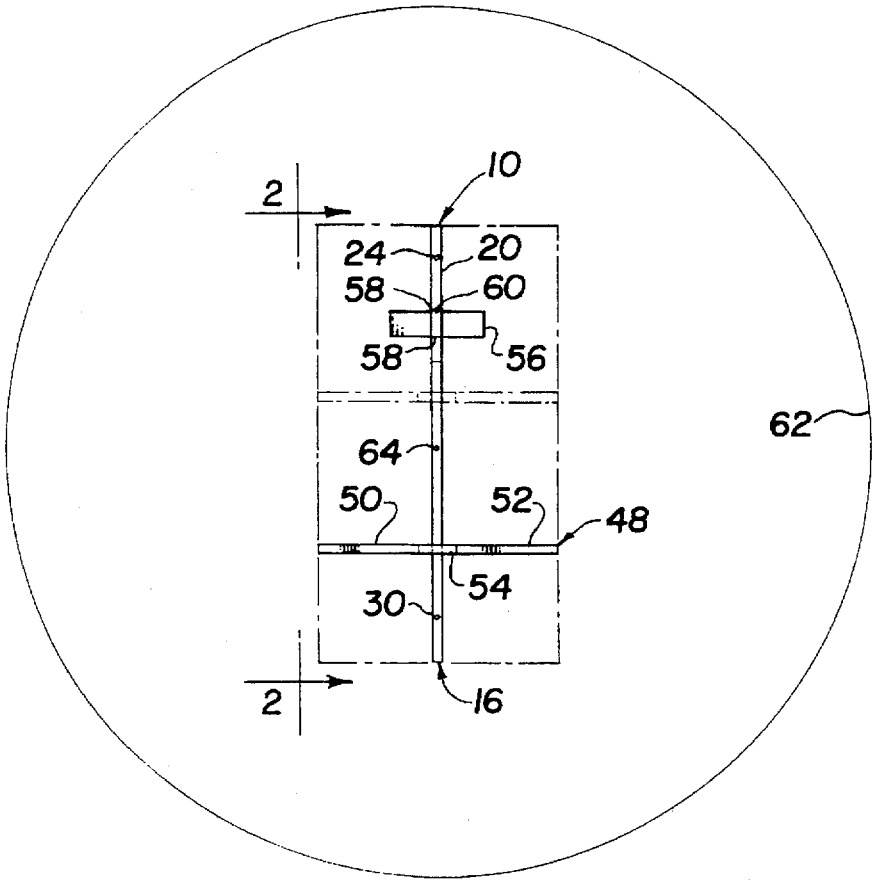
FIG. 1 is a plan view of a device constructed according to the present invention.

Now turning to the drawing, there is shown a device 10 constructed according to the present invention that is used to assist in constructing and repairing a pitcher's mound 12 on a playing surface 14 in a baseball field, which, for purposes of this invention, includes the sport of softball.

A beam apparatus 16 for indicating an upper limit 18 to pitcher's mound 12 is included in device 10. A horizontal extension member 20 is included in beam apparatus 16 to indicated a plane 22 above playing surface 14 that lies substantially parallel to playing surface 14. Horizontal extension member 20 has a connecting passageway 24. An angled extension member 26 is disposed at an angle $\phi$ from a location or point 28 where connected to horizontal extension member 20. It has been determined that angle $\phi$ should be about 5° or about 1 inch of drop per foot of length. Angled extension member 26 has a connecting passageway 30.

Figure 3:
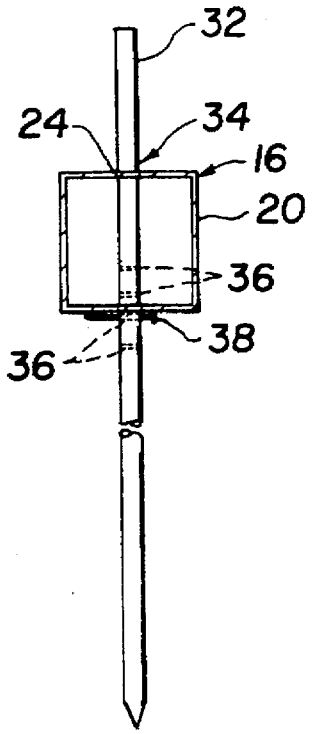
FIG. 3 is an enlarged cross-sectional view of a portion of the device shown in FIG. 2 taken along the lines 3—3 and in the direction of the arrows.
Figure 4:
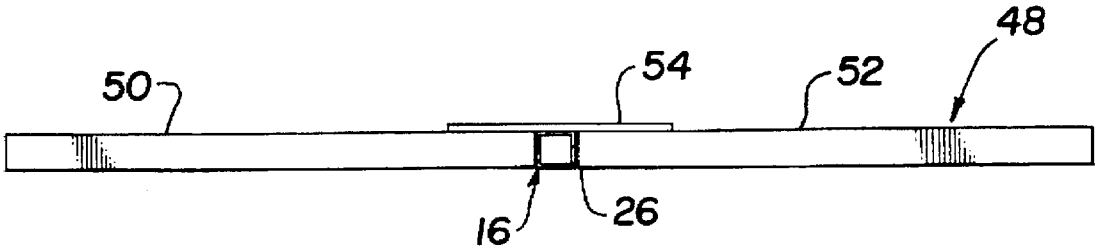
FIG. 4 is a cross-sectional view of a portion of the device shown in FIG. 2 taken along lines 404 and in the direction of the arrows.

Beam apparatus 16 is constructed from tubular steel with a rectilinear cross-section, as best seen in FIGS. 3 and 4 so that one side of the steel tubing is disposed to lie substantially parallel to and form plane 22 with horizontal extension member 20. It has been discovered that device 10 will be light weight and provide a satisfactory result when the tube is 2 inch square tubular steel.

Figure 2:
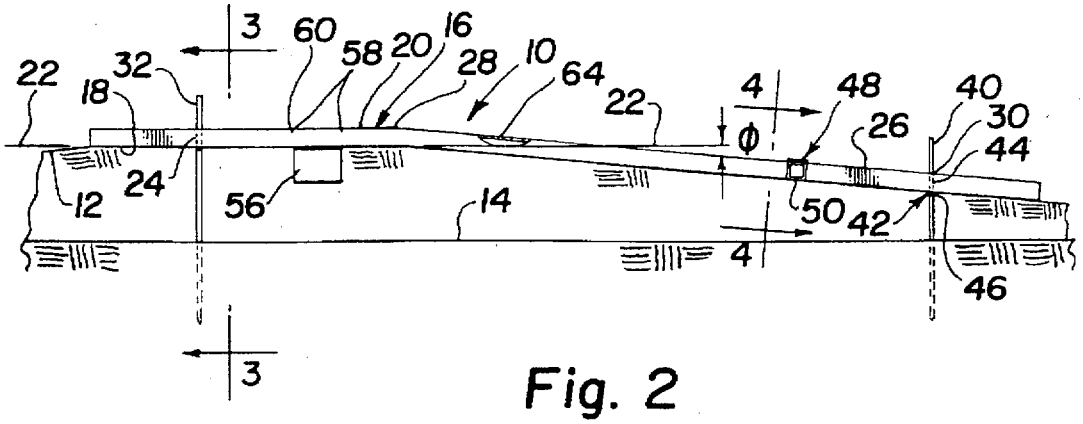
FIG. 2 is an elevational view of the device shown in FIG. 1 taken along the lines 2—2 and in the direction of the arrows.

A first support member 32 is used to support horizontal extension member 20 above playing surface 14 at a position, which forms plane 22. Support member 32 is an elongated metal stake having one end sharpened and the other end substantially flat, (a) a strength sufficient to be driven into the ground forming the playing field and extend through support beam apparatus 16, and (b) a size sufficiently small to be received within connecting passageway 24, as best seen in FIGS. 1–3.

A first detachable connecting apparatus 34 is used to detachably connect horizontal extension member 20 to elongate support member 32 at the position chosen to be in compliance with the rules governing the sport. Detachable connecting apparatus 34 includes a plurality of support passageways 36 disposed along the elongate length of support member 32. A connecting member 38, such as a nail, has a size sufficiently small to extend through each support passageway 36, a length sufficient to extend outwardly of elongate support member 32, and a shear strength sufficient to support beam apparatus 16.

A second support member 40, which is similar to first support member 32 even though shorter, is used to support angled extension member 26 above playing surface 14 at a position below plane 22. Second support member 40 is an elongated metal stake having one end sharpened and the other end substantially flat, (a) a strength sufficient to be driven into the ground forming the playing field and extend through support beam apparatus 16, and (b) a size sufficiently small to be received within connecting passageway 30, as best seen in FIGS. 1–2.

A second detachable connecting apparatus 42, similar to first detachable connecting apparatus 34, is used to detachably connect angled extension member 26 to second elongate support member 40 at the position below plane 22. Second detachable connecting apparatus 42 includes a plurality of support passageways 44, such as those provided in first stake 32, disposed along the elongate length of support member 40. A connecting member 46, such as the nail previously described in relation to first detachable connecting apparatus 34, has a size sufficiently small to extend through each support passageway 44, a length sufficient to extend outwardly of second elongate support member 40, and a shear strength sufficient to support beam apparatus 16.

As best seen in FIGS. 1, 2 and 4, a leveling apparatus 48 is movably connected to beam apparatus 16 for leveling the dirt along the upper surface of pitcher's mound 12. Leveling apparatus 48 has a first leveling arm 50 disposed on one side of extension members 20 and 26 of beam apparatus 16. A second leveling arm 52 is disposed on the opposed side of extension members 20 and 26 of beam apparatus 16. Leveling arms 50 and 52 are connected to one another by a relatively flat plate 54 so that plate 54 and the inboard square cut ends of arms 50 and 52 extend generally transverse or at a 90° angle relative to beam apparatus 16.

As best seen in FIGS. 1 and 2, to indicate a location where a pitcher's rubber 56 is to be provided in pitcher's mound 12, two saw cuts 58 are made into the side surface of horizontal extension member 20 of beam apparatus 16. Leveling arms 50 and 56 of leveling apparatus 48 is moved along horizontal extension member 20 to either one of saw cuts 58 and pitcher's rubber 56 is disposed between the saw cuts. Pitcher's rubber 56 is disposed parallel to arms 50 and 56 and between saw cuts 58 so that it is correctly positioned relative to the playing field.

As best seen in FIG. 1, to indicate a location where an outfield grass line is to be located relative to pitcher's mound 12, a hole 60 is drilled or bored through the upper surface of horizontal extension member 20 of beam apparatus 16.

To indicate a location where an outer edge 62 of pitcher's mound 12 exists, a hole 64 is drilled or bored through the upper surface of angle extension member 26 of beam apparatus 16.

When constructing a new pitcher's mound for a professional baseball field, a string is drawn between the back corner of home plate to the center of second base. Depending on the length of beam apparatus 16, the location of connecting passageway 30 in angled extension member 26 and the position in which pitcher's rubber 56 is to be located in relation to the field, a distance is determined from the back corner of home plate and measured. When beam apparatus 16 has a length of 106.104 inches (269.50 cm), horizontal extension member 20 has a length of 34 inches (86.36 cm), angled extension member 26 is connected at a slope of 5°, connecting passageway 30 is 12.174 inches (30.92 cm) from the end of beam apparatus 16 nearest to home plate and the edge of pitcher's rubber 56 facing the home plate is 78.104 inches (198.38 cm) from the end of beam apparatus 16 nearest to home plate, then stake 40 is to be located fifty-five feet from the back corner of home plate.

After determining the distance, stake 40 is driven straight into the ground directly under the drawn string and sufficiently deep to be stable. Connecting passageway 30 is aligned over stake 40 and beam apparatus 16 lowered in alignment with the drawn string and connecting passageway 24 nearest to second base. Stake 32 is driven straight through passageway 24 into the ground directly under the drawn string and sufficiently deep to be stable. The end of beam apparatus 16 nearest to home plate is raised four inches above playing surface 14 and nail 46 is inserted into the correct support passageway 44. The end of beam apparatus 16 nearest to second base is raised ten inches above playing surface 14 and nail 38 is inserted into the correct support passageway 36. Leveling apparatus 48 is placed on and connected to beam apparatus 16.

Dirt is filled to the bottom and to the ends of beam apparatus 16 and to the ends of leveling apparatus 48 and compacted. Leveling apparatus 48 is moved along beam apparatus 16 to establish that sufficient dirt is provided under device 10. Outer edge 62 of pitcher's mound 12 is measured by using indicator 64 at the center, and marking a circle with a radius of nine feet around device 10. Dirt is then added to form a slope from the line to the surface of the previously compacted dirt filled in beneath device 10 and compacted. Outwardly of this circle, grass may be planted as part of the infield.

After located indicator 58 on beam apparatus 16, dirt is removed where pitcher's rubber 56 is to be centered under horizontal extension member 20. Leveling apparatus 48 is aligned with indicator 48 to form an edge that extends substantially transverse to beam apparatus 16 to assist in the proper positioning of pitcher's rubber 56 in relation to the baseball playing field.

After locating indicator 60, a part of a circle with a radius of 95 feet is drawn outwardly of which grass may be grown for the outfield portion of the baseball playing field.

When reconstructing an older pitcher's mound for professional baseball and using the previously identified device 10, the only significant difference is to use an offset device to determine the height of four and ten inches at which to support the ends of beam apparatus 16 above playing surface 14. Once device 10 is properly positioned above playing surface 14, a damaged pitcher's mound can be repaired in substantially the same manner as previously explained.

The invention having been described, what is claimed is:

1. A device for constructing a pitcher's mound on the playing surface of a baseball field, comprising;

a tubular beam for indicating an upper limit of a said pitcher's mound; said beam having a first section to be positioned substantially parallel to a substantially horizontal playing surface of a baseball field, and a second section which extend downwardly at a predetermined angle relative to said first section when said first section is placed substantially horizontal on said playing surface;

means for supporting said beam at a predetermined elevation above said playing surface;

a pitcher's rubber indicating means disposed on said first section for indicating the location of a pitcher's rubber on a said pitcher's mound;

elongated leveling means extending along opposite sides and movable along said beam for leveling dirt along an upper surface of a constructed pitcher's mound.

2. A device as set forth in claim 1, further comprising:

indicating means provided on said first section for indicating a point from where an outfield grass line is to be measured.

3. A device as set forth in claim 1, further comprising:

indicating means provided on said second section for indicating a point from where an outer edge of the pitcher's mound is to be measured and located.

4. A device as defined in claim 1, wherein, said means for supporting said beam is and elongated stakes.

5. A device for constructing a pitcher's mound on the playing surface of a baseball field, comprising:

a tubular beam for indicating an upper limit of a pitcher's mound; said beam having a first section to be positioned substantially parallel to a substantially horizontal playing surface of a baseball field, and a second section which will extend downwardly at a predetermined angle relative to said first section when said first section is placed substantially horizontal on said playing surface of a said baseball field; each of said first and second sections having an anchor receiving opening extending therethrough;

means extending through said openings for supporting said beam at a predetermined elevation above a said horizontal playing surface;

pitchers rubber indicating means disposed on said first section for indicating the location of a pitcher's rubber on a pitchers mound;

means on said first section for indicating a point from where an outfield grass is to be measured;

means on said second section for indicating a point from where the outer edge of a pitcher's mound is to be measured; and leveling means movably connected to said beam for leveling dirt along an upper surface of a constructed pitcher's mound; said leveling means having first and second leveling arms, each arm being disposed on opposite sides of said beam and connected to one another.

6. The device as defined in claim 5, wherein said means extending through said openings are elongated stakes; said stakes having a plurality of transverse, spaced apart opening along the length thereof;

an elongate detachable connecting means for selective placement through said openings to support said beam at a desired elevation above a said playing surface.

* * * * *